US009028908B1

(12) United States Patent
DeTar et al.

(10) Patent No.: US 9,028,908 B1
(45) Date of Patent: May 12, 2015

(54) METHOD FOR APPLYING FLUID TO WIRE

(75) Inventors: Marvin B. DeTar, Wickliffe, OH (US); Greg S. Caudill, Fort Wayne, IN (US); Matthew Leach, Fort Wayne, IN (US); John M. Swihart, Larwill, IN (US); Baber Inayat, Ft. Wayne, IN (US)

(73) Assignee: Essex Group, Inc., Fort Wayne, IN (US)

( * ) Notice: Subject to any disclaimer, the term of this patent is extended or adjusted under 35 U.S.C. 154(b) by 984 days.

(21) Appl. No.: 12/932,871

(22) Filed: Mar. 7, 2011

(51) Int. Cl.

| | |
|---|---|
| ***B05D 5/12*** | (2006.01) |
| ***B05D 1/28*** | (2006.01) |
| ***C23C 2/38*** | (2006.01) |
| ***C23C 2/18*** | (2006.01) |

(52) U.S. Cl.
CPC ... *B05D 1/28* (2013.01); *C23C 2/38* (2013.01); *C23C 2/185* (2013.01)

(58) Field of Classification Search
USPC ..... 427/117–120, 356, 359, 428.01, 427/428.15, 429
See application file for complete search history.

(56) References Cited

U.S. PATENT DOCUMENTS

| | | | | |
|---|---|---|---|---|
| 2,311,572 | A * | 2/1943 | Reynolds | 428/172 |
| 2,560,572 | A * | 7/1951 | Haywood et al. | 427/428.1 |
| 2,589,302 | A * | 3/1952 | Snowman, Jr. | 427/288 |
| 3,119,169 | A * | 1/1964 | Holbrook | 28/143 |
| 3,531,344 | A * | 9/1970 | Beebe et al. | 156/83 |
| 3,647,525 | A * | 3/1972 | Dahlgren | 427/428.15 |
| 3,832,271 | A * | 8/1974 | Humphries | 428/462 |
| 4,250,207 | A * | 2/1981 | Takahashi et al. | 427/211 |
| 5,310,573 | A * | 5/1994 | Tanokuchi et al. | 427/9 |
| 5,382,455 | A | 1/1995 | Boockmann | |
| 5,409,535 | A | 4/1995 | Boockmann | |
| 2003/0091869 | A1 * | 5/2003 | Otto et al. | 428/697 |
| 2004/0062873 | A1 * | 4/2004 | Jung et al. | 427/407.1 |

OTHER PUBLICATIONS

Boockmann, G., "Innovation for Magnet Wire Lubrication" Boockmann GmbH , Edition Aug. 22, 1997.
Boockmann GmbH, "Lubrication of Winding Wires—Standard single line" BE 9610/721.
Slovent Free LUB—Application for Magnet Wires Sytem MAG "Meltlub", Gerhard JOEBSTL, Sep. 2001.

* cited by examiner

*Primary Examiner* — Brian K Talbot

(57) ABSTRACT

A system of rollers can transfer fluid from a reservoir to an electrically conductive wire feeding past the reservoir. The system can include a first cylinder that contacts the reservoir and rotates to pick up fluid from the reservoir. A second cylinder can contact the first cylinder and rotate. Fluid can transfer between the first cylinder and the second cylinder. The second cylinder can contact the feeding wire such that the second cylinder applies the fluid to the wire as the wire feeds past the second cylinder. Accordingly, two rotating cylinders can cooperatively transfer fluid from the reservoir to the moving wire.

24 Claims, 11 Drawing Sheets

METHOD FOR APPLYING FLUID TO WIRE

FIELD OF THE TECHNOLOGY

The present invention relates to manufacturing electrically conductive wire and more particularly to coating wire via feeding the wire past a reservoir with a system of rotating cylinders transferring fluid from the reservoir to the wire.

BACKGROUND

Electrically conductive wire finds numerous applications involving transmitting electricity, such as for magnet winding (e.g. winding or magnet wire), conducting electrical power, and carrying electrical signals. For many such applications, one or more electrically conductive filaments is coated with fluid during wire production.

Conventional technology for coating wires exhibits performance limitations, particularly in a high-speed manufacturing context. Most conventional systems and processes for applying fluid to wire have shortcomings associated with: economics; throughput due to line speed constraints and single-wire processing; consumable elements involving expense and personnel resources; equipment maintenance and supervision; and fluid containment limitations resulting in fouling, spillage, and debris. Additionally, some conventional technologies utilize solvents about which some parties have expressed concerns from an environmental perspective.

Accordingly, a need exists for technology to apply fluid to wire. A need is apparent for a technology that addresses environmental concerns. Another need is apparent for technology suited to high-speed, volume manufacturing. Another need is apparent for a technology capable of applying fluids to multiple wires of differing diameters simultaneously. Another need is apparent for a technology that can be implemented and operated economically. Another need is apparent for a technology that avoids excessive operating personnel and maintenance resources. Another need is apparent for a technology that can maintain cleanliness and avoid debris and waste in the manufacturing facility. Another need is apparent for a technology that tolerates misalignment and process fluctuations. A technology addressing one or more such needs, or some other shortcoming in the art, would benefit the many applications that utilize coated wire.

SUMMARY

In one aspect of the present invention, a system can apply fluid to wire. Rollers of the system can apply the fluid to the wire as the wire feeds through the system. The system can comprise a reservoir that holds fluid to be applied. A first roller in contact with reservoir can pickup fluid from the reservoir as the first roller rotates. A second roller can rotate alongside the first roller. Fluid can transfer between the rotating first roller and the rotating second roller, so that the second roller becomes wetted with the fluid. The rotating second roller can contact the wire as the wire feeds through the system, thereby applying the fluid to the wire.

The foregoing discussion of applying fluid to a wire is for illustrative purposes only. Various aspects of the present invention may be more clearly understood and appreciated from a review of the following detailed description of the disclosed embodiments and by reference to the drawings and the claims that follow. Moreover, other aspects, systems, methods, features, advantages, and objects of the present invention will become apparent to one with skill in the art upon examination of the following drawings and detailed description. It is intended that all such aspects, systems, methods, features, advantages, and objects are to be included within this description, are to be within the scope of the present invention, and are to be protected by the accompanying claims.

Figure 1A:
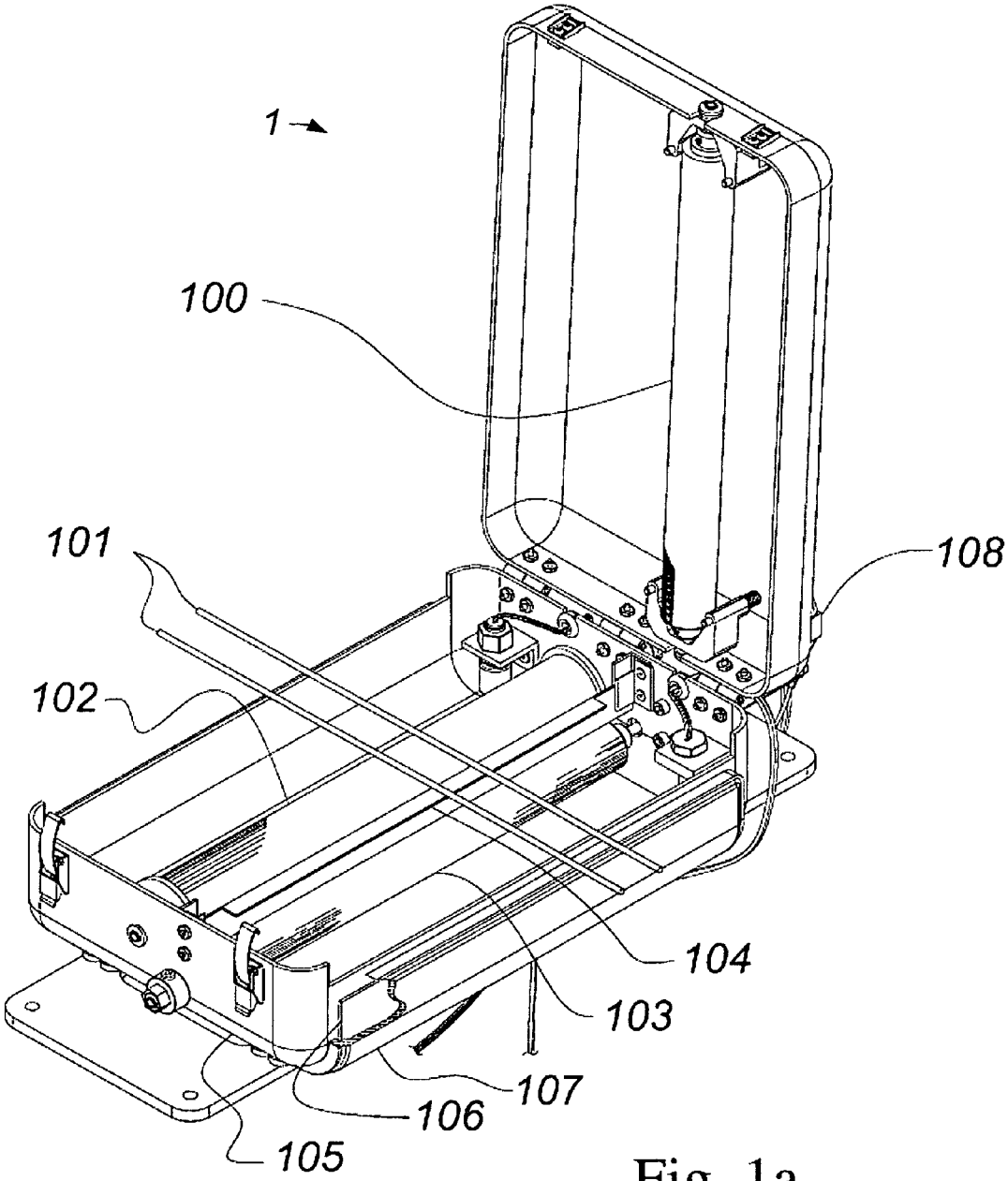
FIGS. 1*a*, 1*b*, 1*c*, and 1*d* (collectively FIG. 1) are illustrations of a fluid applicator system for applying fluid to wire in accordance with certain exemplary embodiments of the present invention.

Many aspects of the invention can be better understood with reference to the above drawings. The elements and features shown in the drawings are not to scale, emphasis instead being placed upon clearly illustrating the principles of exemplary embodiments of the present invention. Moreover, certain dimensions may be exaggerated to help visually convey such principles. In the drawings, reference numerals designate like or corresponding, but not necessarily identical, elements throughout the several views.

DETAILED DESCRIPTION OF EXEMPLARY EMBODIMENTS

Technology for applying fluid to wires will now be described more fully with reference to FIGS. 1-8, which illustrate representative embodiments of the present invention.

In an exemplary embodiment of the present invention, an applicator can apply fluid onto one or more wires with improved control of application rate, resulting in precise regulation of the amount of fluid applied to the wires. The applicator can comprise a reservoir with fluid having a top surface defined by and oriented perpendicular to gravity and a bottom side running substantially parallel to a lower mechanical surface, such as the bottom of the reservoir or a housing bottom. Adjacent wires flowing through the applicator can define a plane of travel between two rotating cylinders, one for applying fluid and one for providing pressure on the wires. The applicator can tolerate misalignment and other variations, such as being mounted out of plumb or tilted with respect to Earth. For example, the applicator can operate effectively with the reservoir top surface, the bottom surface, and the plane of wire travel skewed relative to one another or forming acute or obtuse angles.

The invention can be embodied in many different forms and should not be construed as limited to the embodiments set forth herein; rather, these embodiments are provided so that this disclosure will be thorough and complete, and will fully convey the scope of the invention to those having ordinary skill in the art. Furthermore, all "examples" or "exemplary embodiments" given herein are intended to be non-limiting and among others supported by representations of the present invention.

Turning now to FIG. 1, this figure illustrates an exemplary fluid applicator system 1 for applying fluid to wire 101 according to certain embodiments of the present invention. In particular, FIG. 1 shows an assembly view for an exemplary embodiment of the fluid applicator system 1.

As illustrated, the fluid applicator system 1 comprises a housing 105 with a lid 3 that is hinged to facilitate efficient maintenance and various operator interventions. The housing 105 is insulated with insulation 107. A heating element 106 heats the housing 105, for example to maintain a molten state for material in a reservoir formed by the housing 105 or to control fluid viscosity. A system of rollers transfers fluid from the reservoir to the wires 101, including a pickup roller 103 with an associated doctor blade 104, an application roller 102, and a pressure roller 100. A roller drive system comprises a motor 108 that attaches to the housing 105 via a bracket 10. The motor 108 drives the application roller 102 through a coupler 109.

Figure 1B:
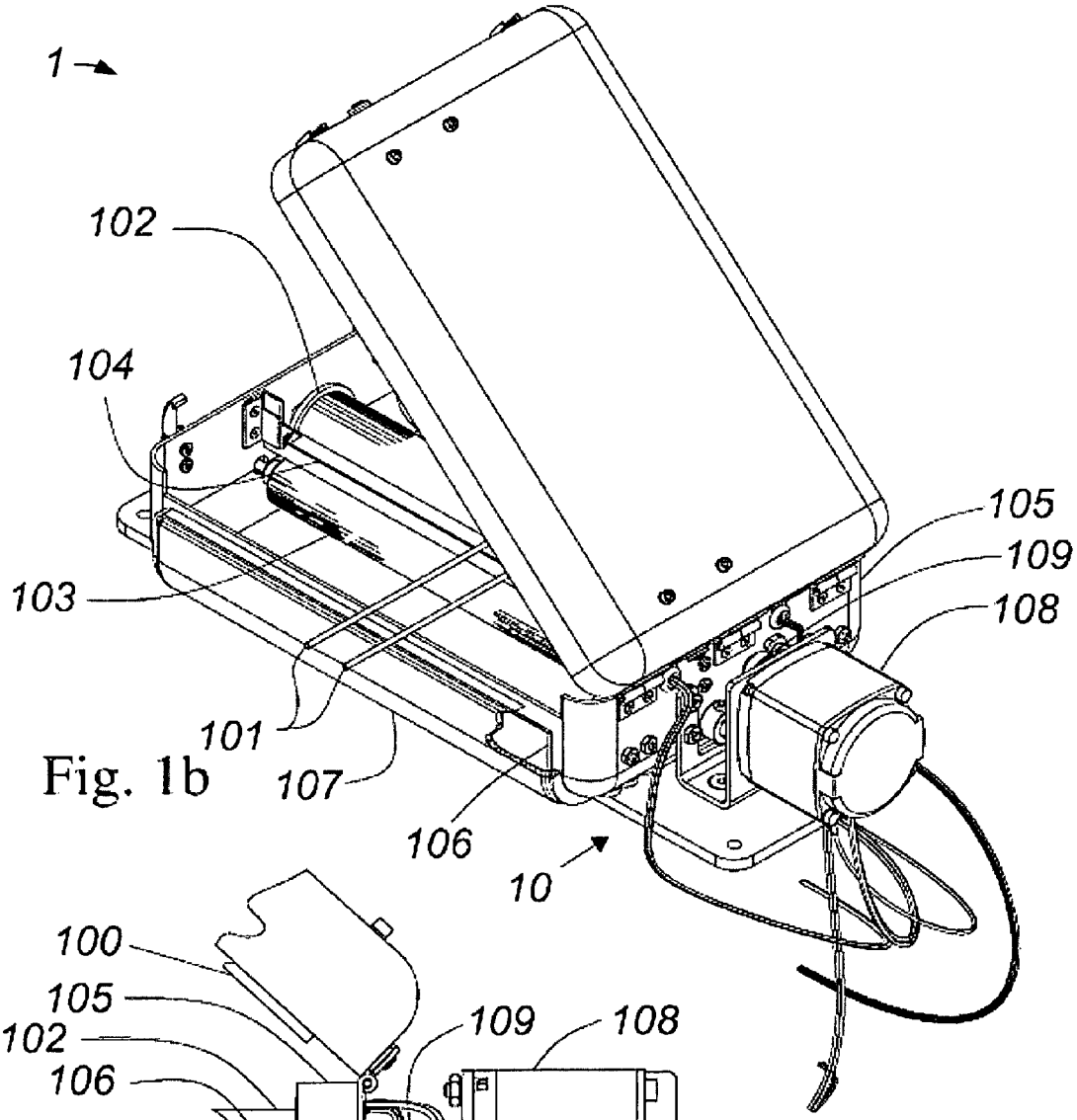
Figure 1C:
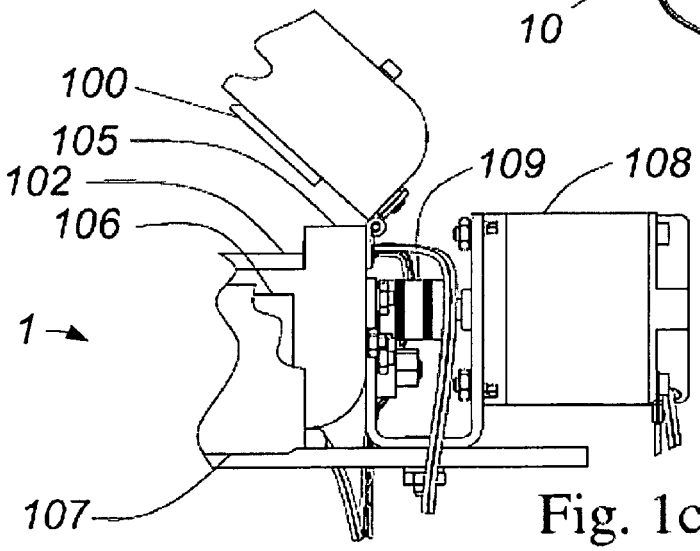
Figure 1D:
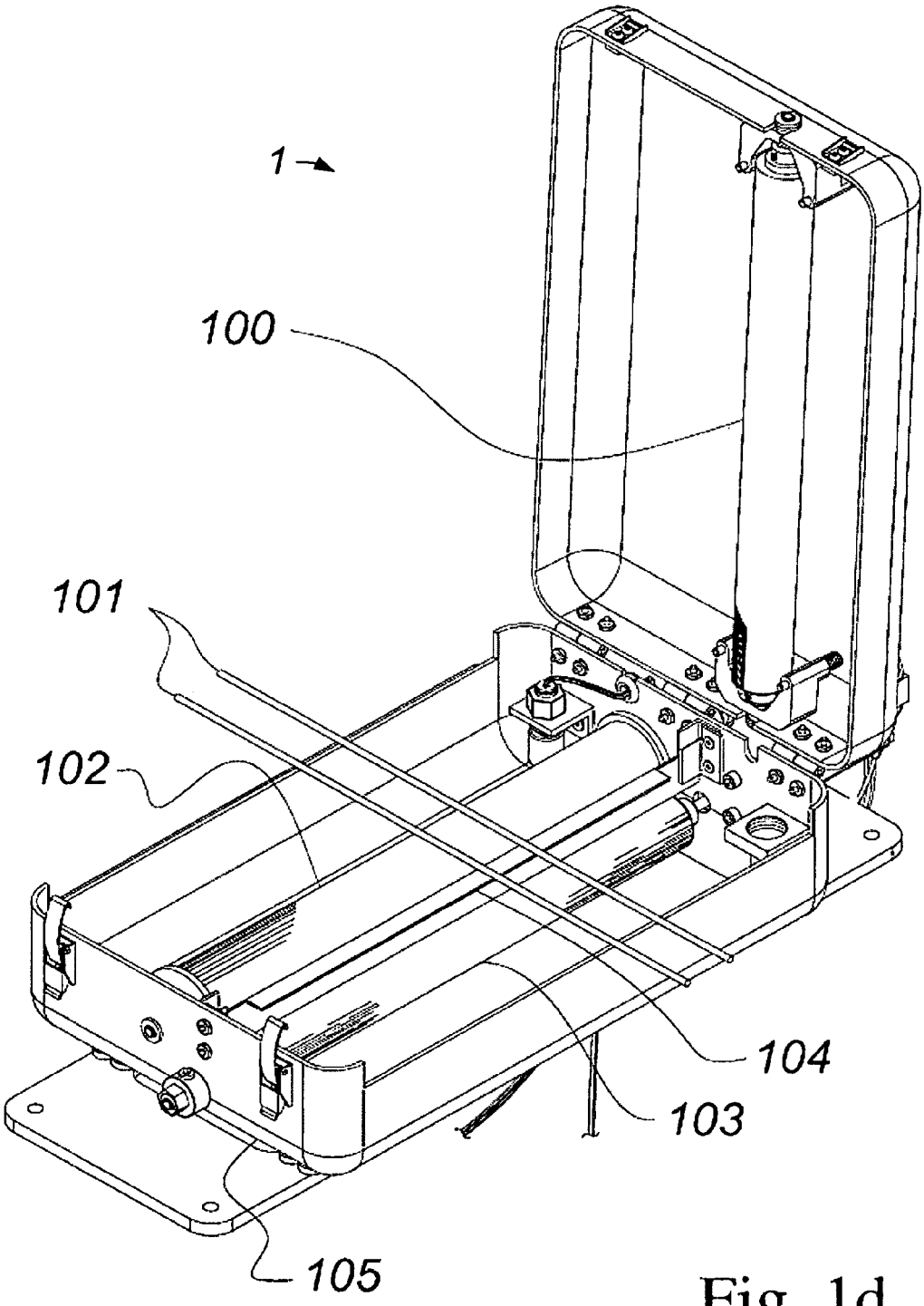
Figure 2:
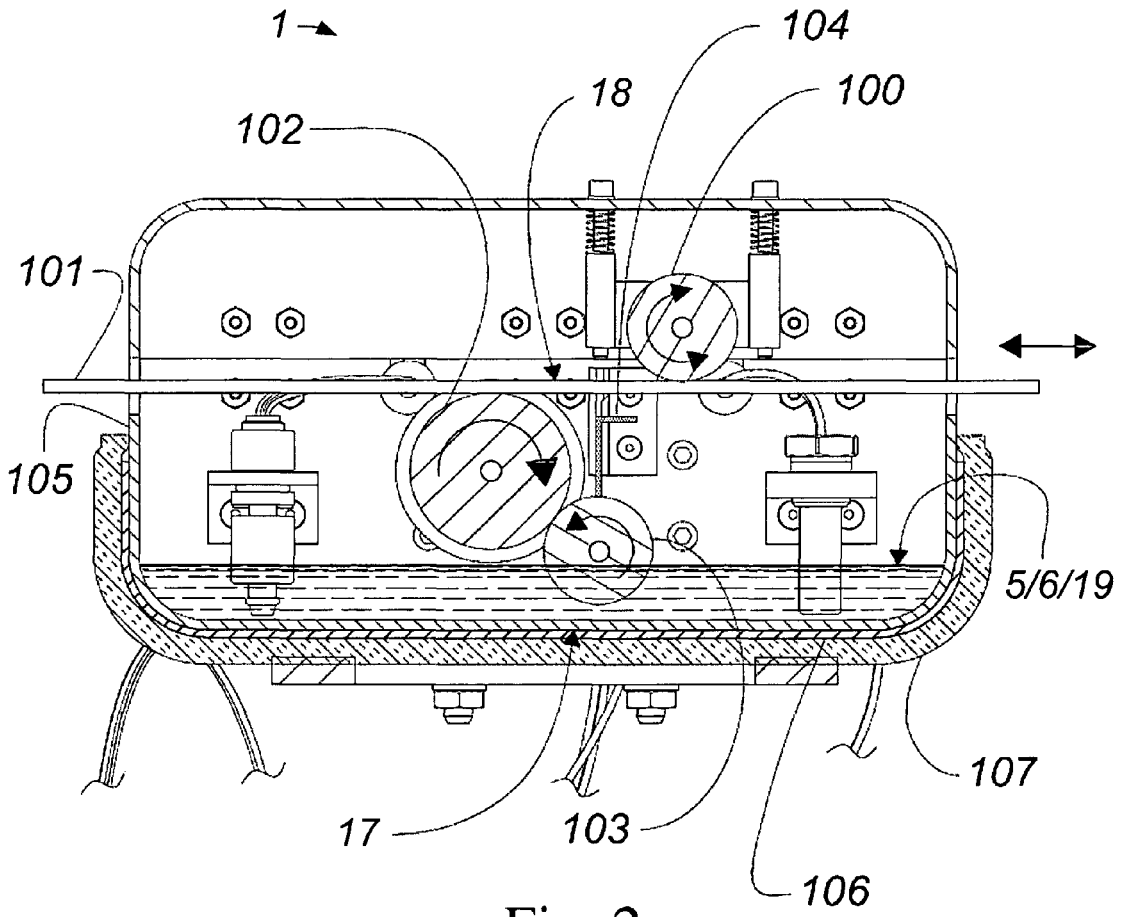
FIG. 2 is an illustration, in cross sectional view, of a fluid applicator system for applying fluid to wire in accordance with certain exemplary embodiments of the present invention.

Turning briefly to FIG. 2, this figure illustrates, in cross sectional view, an exemplary fluid applicator system 1 for applying fluid 5 to wire 101 according to certain embodiments of the present invention. FIG. 2 shows a fluid applicator system 1 in an exemplary mode of operation. As illustrated, an interior surface of the housing 105 defines a reservoir 6 of fluid 5. The pickup roller 103 takes fluid 5 from the reservoir. The fluid 5 transfers from the pickup roller 103, after passing the doctor blade 104, onto the applicator roller 102, and then onto one or more wires 101 passing through the fluid applicator system 1. The fluid applicator system 1 illustrated in FIG. 2 can be the same fluid applicator system 1 illustrated in FIG. 1 and will be discussed below in such an exemplary context, without limitation.

Referring now to FIGS. 1 and 2, wires 101 contact the application roller 102 and are also in contact with the pressure roller 100 during operation, when the lid 3 of the fluid applicator system 1 is closed. The pressure roller 100 is located in and attached to the lid 3 of the housing 105. The pressure roller 100 guides the wires 101 for continuous contact with the application roller 102, for continuous fluid application.

As illustrated, the wires 101 contact the application roller 102 before contacting the pressure roller 100. Alternatively, in certain embodiments, the wire 101 may contact the pressure roller 100 prior to contacting the application roller 102. In the latter embodiment, the pressure roller 100 can be moved upstream from the application roller 102. In both cases, fluid application at the applicator roller 102 can determine the amount of fluid 5 that is applied to the wires 101, and the amount of fluid 5 retained downstream from the pressure roller 100 will reach steady state.

As best seen in FIG. 1*b*, a motor 108 drives the application roller 102. FIG. 1*c* illustrates a coupler 109 that transfers energy from the motor 108 to directly drive the applicator roller 102. FIG. 1*d* illustrates the fluid applicator system 1 in a configuration suited to applying ambient temperature fluids, with heating element 106 and insulation 107 removed.

In an exemplary mode of operation, multiple wires 101 exit the fluid applicator system 1 after contact with the pressure roller 100. In certain embodiments, a brush or cloth wick can be deployed with or substituted for the pressure roller 100. Various follower devices can be utilized.

In some embodiments, the fluid applicator system 1 may be used with exactly one wire passing through the system 1. In other embodiments, two or more wires 101 pass through the fluid applicator system 1 simultaneously. In many volume manufacturing circumstances, more than three wires 101 feed through the fluid applicator system 1 simultaneously, thereby applying a consistent amount of fluid 5 to each wire 101 simultaneously. In one exemplary embodiment, an array of twelve spaced-apart wires 101 passes through the fluid applicator system 1 and is coated. The illustrated fluid applicator system 1 offers an advantage of applying a substantially common amount of fluid 5 to each of multiple wires 101 at the same time. As discussed below, the fluid application can be uniform across multiple wires 101 of differing sizes coated simultaneously.

The fluid 5 can comprise one or more enamels, lubricants, insulation materials, hot melt materials, curable materials, substances that polymerize after application, and/or antioxidants, to mention a few representative examples. The fluid 5 can be a solid, a viscous liquid, a suspension, a mixture, a blend, a colloid, or a liquid at ambient temperature and may be heated to form a liquid at the application temperature. In certain exemplary embodiments, the fluid 5 is solid at a temperature of 40 degrees Celsius and below. In certain exemplary embodiments, the fluid 5 is substantially free of solvents, or can have less than about 6.0 percent solvent by weight. In certain exemplary embodiments, the fluid 5 comprise particles.

In certain exemplary embodiments, a fluid level sensor is linked to a flow valve via a feedback control loop to provide consistent fluid level in the fluid applicator system 1. The resulting fluid level control supports consistent fluid application onto the wires 101.

The wires 101 may be formed of an electrically conductive metallic material such as copper, aluminum, or an alloy. In certain applications, the wires 101 may have a composite composition, for example a metallic material plus one or more polymers, inorganic oxides, organic coatings, or ceramics, or a combination of two or more such materials. In cross section, the wires 101 can have a geometric form that appears hexagonal, round, rectangular, square, or some other appropriate shape, for example.

Certain exemplary modes of operation achieve a fine application of a very small amount of fluid transfer onto the wires 101. The application amount is achieved by transfer of the fluid onto the application roller 102 and by transfer of the fluid 5 to and from the pickup roller 103. The fluid on the pickup roller 103 is metered by a weighted doctor blade 104.

In an exemplary embodiment, the doctor blade 104 can be made of polycarbonate or another polymeric material that is compatible with the fluid 5. The pickup roller 103 can comprise a stainless steel cylinder that is textured, patterned, embossed, knurled, structured, or roughed to facilitate fluid pickup. For example, the pickup roller 102 can be finished to about 0.000063 inches of surface roughness or another appropriate fabrication specification.

In the illustrated embodiment, the doctor blade 104 is disposed above the pickup roller 103 prior to transfer of fluid 5 onto the application roller 102. As illustrated, the application roller 102 is out of direct contact with the fluid 5 that is in the reservoir 6, which can be viewed as a sump in the illustrated embodiment. That is, the application roller 102 can be disposed out of and above the reservoir 6.

A controlled amount of lateral transfer of fluid 5 occurs where the fluid 5 contacts the doctor blade 104 and where the pickup roller 103 and the application roller 102 contact, resulting in precise regulation of the amount of fluid 5 applied to the wires 101. The amount of fluid 5 on the applicator roller 102 can be varied, for example dynamically adjusted, to control amount of fluid applied to each wire 101. Speed of the wires 101 traveling through the fluid applicator system 1 also can be set (or dynamically varied) to control amount of fluid applied to each wire 101.

As discussed above and shown in FIG. 1*b* the applicator roller 102 can be driven by the motor 108 via the coupler 109, which is visible in FIG. 1*c*. In certain embodiments, a motor controller provides speed adjustment of the application roller 102 from about 0 to about 6 revolutions per minute (rpm). The amount or thickness of fluid 5 applied to the wires 101 can be metered via varying the speed of the surface of the application roller 102 relative to the speed of the wires 101. The certain embodiments, the motor 108 turns the application roller 102 at about 0.3 to about 0.5 rpm. However, various other speeds can be useful depending on application specifics, such as wire diameter, line speed, and desired fluid application rate. In certain exemplary embodiments, varying the speed of the application roller 102 accommodates wire speeds ranging from about 100 feet per minute to about 1,000 feet per minute.

In certain embodiments, the motor 108 directly drives only the pickup roller 103. In certain embodiments, the motor 108 (or multiple motors) directly drive both the pickup roller 103 and the application roller 102.

In certain modes of operation of the fluid applicator system 1, viscosity of the fluid 5 may be controlled using the heating element 106. The insulation 107 can help control heat loss. The insulation 107 can further be used to prevent accidental direct contact with the heating element 106. An over-temperature control sensor can be included to avoid overheating. As illustrated in FIG. 1*d*, the heating element 106 and/or the insulation 107 can be removed as may be appropriate for certain applications in which heat control is not desired.

Figure 3:
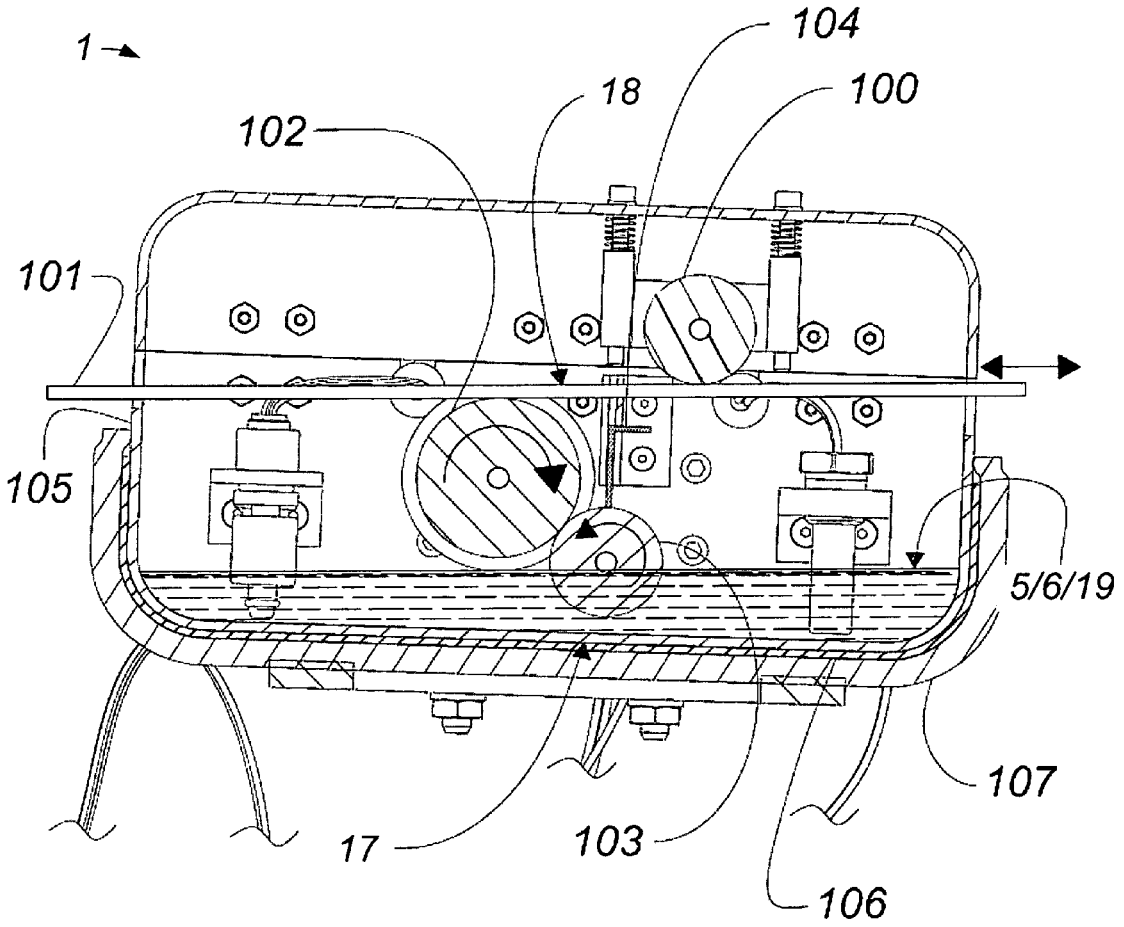
FIG. 3 is an illustration, in cross sectional view, of a fluid applicator system for applying fluid to wire in accordance with certain exemplary embodiments of the present invention.

Turning now to FIG. 3, this figure illustrates, in cross sectional view, an exemplary fluid applicator system 1 for applying fluid 5 to wire 101 according to certain embodiments of the present invention. In certain embodiments, the fluid applicator system 1 illustrated in FIG. 3 can be an instance of the fluid applicator system 1 illustrated in FIGS. 1 and 2 and as discussed above. FIG. 3 will be discussed in such a representative context, without limitation.

FIG. 3 shows the fluid applicator system 1 operating in an environment where the housing 105 is tilted relative to the Earth's surface. A plane 17 defined by the bottom of the housing interior that forms the reservoir 6 is tilted relative to the surface plane 19 of the fluid 5. In this skewed orientation, the fluid applicator system 1 continues to achieve a consistent application of fluid 5 to the wires. One advantage of this capability is to aid in quickly removing fluid 5 from the reservoir 6.

The fluid applicator system 1 can also provide consistent fluid application with the plane 18 defined by the wires 101 skewed relative to the plane 17 and/or the surface plane 19. The fluid applicator system 1 can operate effectively with one or both of plane 17 and plane 18 disposed at an acute angle relative to plane 19, and further with plane 17 and plane 18 at an acute and an obtuse angle relative to plane 19. These capabilities to operate effectively with angular misalignment reduce installation constraints and expense for installation of the fluid applicator system 1 and further reduce operational sensitivity.

As illustrated in FIG. 3, the wires 101 can feed from either side of the fluid applicator system 1. Further, the pickup roller 103 and the application roller 102 can turn in opposite rotational directions (one clockwise and the other counterclockwise when viewed from a common site) to form a nip, as illustrated. The pressure roller 100 does not have to have a rotational motion. The adjustment of the alignment of pressure roller 100 may generate insufficient frictional force to generate rotational motion of the pressure roller 100.

Figure 4:
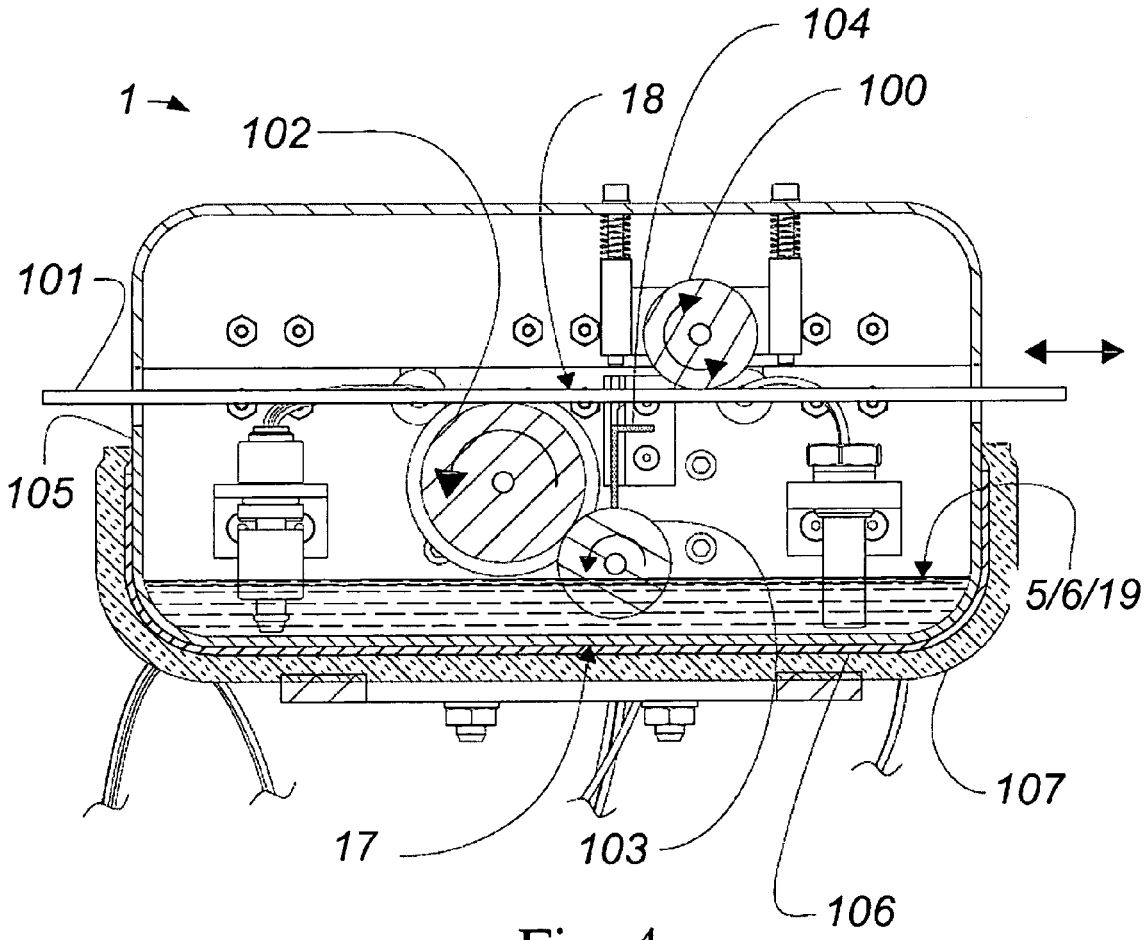
FIG. 4 is an illustration, in cross sectional view, of a fluid applicator system for applying fluid to wire in accordance with certain exemplary embodiments of the present invention.

Turning now to FIG. 4, this figure illustrates, in cross sectional view, an exemplary fluid applicator system 1 for applying fluid 5 to wire 101 according to certain embodiments of the present invention. In certain embodiments, the fluid applicator system 1 illustrated in FIG. 4 can be an instance of the fluid applicator system 1 illustrated in FIGS. 1 and 2 and as discussed above. FIG. 4 will be discussed in such a representative context, without limitation.

FIG. 4 shows the fluid applicator system 1 in a mode of operation where the pickup roller 103 and the application roller 102 turn in a common rotational direction (counterclockwise in the illustrated view). To achieve a controlled amount of fluid 5 onto the wires 101, the pickup roller 103 receives the fluid 5 from the reservoir 6. Fluid 5 is then metered past a doctor blade 104 and is transferred onto the application roller 102 where fluid is transferred onto the moving wires 101.

Figure 5A:
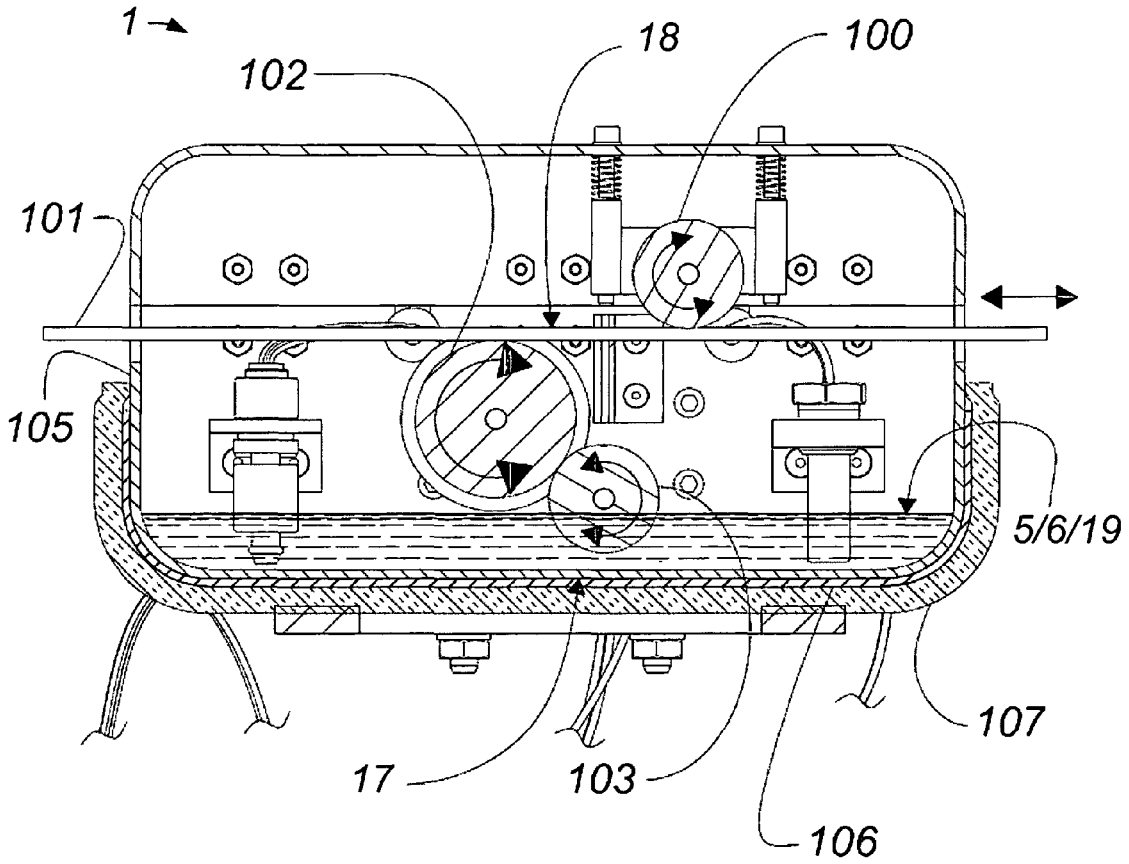
FIG. 5*a* is an illustration, in cross sectional view, of a fluid applicator system for applying fluid to wire in accordance with certain exemplary embodiments of the present invention.

Turning to FIG. 5*a*, this figure illustrates, in cross sectional view, an exemplary fluid applicator system 1 for applying fluid 5 to wire 101 according to certain embodiments of the present invention. In the illustrated embodiment, the fluid applicator system 1 is operated without a doctor blade. The fluid applicator system 1 of FIG. 5*a* can be an embodiment of the fluid applicator system 1 illustrated in FIGS. 1 and 2 as discussed above, but with the doctor blade 104 removed.

In several modes of application of fluid 5 onto the wires 101, the pickup roller 103 and application roller 102 can be operated in varied rotational directions while fluid 5 transfers initially to the pickup roller 103.

Referring now to FIGS. 5*b*, 5*c*, 5*d*, and 5*e*, these figures illustrate an exemplary fluid applicator system 1 depicting roller rotational directions for applying fluid 5 to wire 101 according to certain embodiments of the present invention. More specifically, these figures illustrate different operational modes and fluid delivery paths for embodiments of the fluid applicator system 1. FIGS. 5*b*, 5*c*, 5*d*, and 5*e* are taken from a common viewing perspective. The illustrated embodiments can be readily selected empirically (without undue experimentation) to achieve desired amounts of fluid transfer, which will vary from application to application and between manufactured wire products.

The pressure roller 100 is not illustrated in FIGS. 5*b*, 5*c*, 5*d*, and 5*e*, but can be located upstream or downstream. In certain embodiments, the fluid applicator system 1 can be operated without a pressure roller 100. In certain embodiments, the fluid applicator system 1 can be operated with two (or more) pressure rollers 100, for example one or more upstream of the applicator roller 102 and one or more downstream.

Figure 5B:
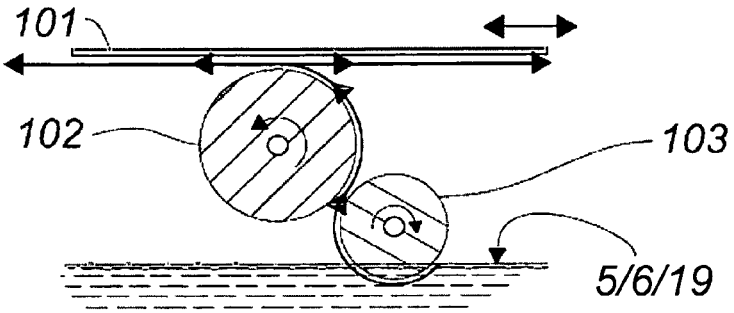
FIG. 5*b* is an illustration of a fluid applicator system depicting roller rotational directions for applying fluid to wire in accordance with certain exemplary embodiments of the present invention.

FIG. 5*b* illustrates the pickup roller 103 rotating clockwise while the applicator roller 102 rotates counterclockwise. In certain embodiments, the pickup roller 103 is downstream from the applicator roller 102. In certain embodiments, the applicator roller 102 is downstream from the pickup roller 103. In certain embodiments, the wires 101 flow from left to right, while in other embodiments, the wires 101 flow from right to left.

Figure 5C:
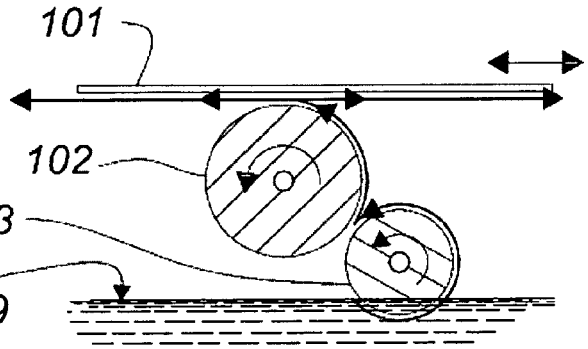
FIG. 5*c* is an illustration of a fluid applicator system depicting roller rotational directions for applying fluid to wire in accordance with certain exemplary embodiments of the present invention.

FIG. 5*c* illustrates the pickup roller 103 rotating counterclockwise while the applicator roller 102 rotates counterclockwise. In certain embodiments, the pickup roller 103 is downstream from the applicator roller 102. In certain embodiments, the applicator roller 102 is downstream from the pickup roller 103. In certain embodiments, the wires 101 flow from left to right, while in other embodiments, the wires 101 flow from right to left.

Figure 5D:
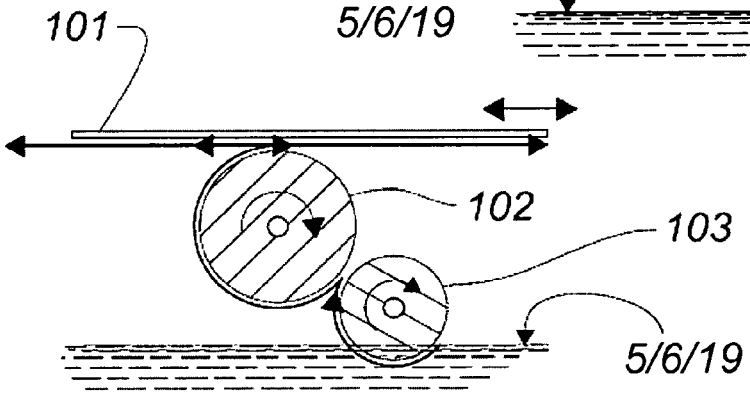
FIG. 5*d* is an illustration of a fluid applicator system depicting roller rotational directions for applying fluid to wire in accordance with certain exemplary embodiments of the present invention.

FIG. 5*d* illustrates the pickup roller 103 rotating clockwise while the applicator roller 102 rotates clockwise. In certain embodiments, the pickup roller 103 is downstream from the applicator roller 102. In certain embodiments, the applicator roller 102 is downstream from the pickup roller 103. In certain embodiments, the wires 101 flow from left to right, while in other embodiments, the wires 101 flow from right to left.

Figure 5E:
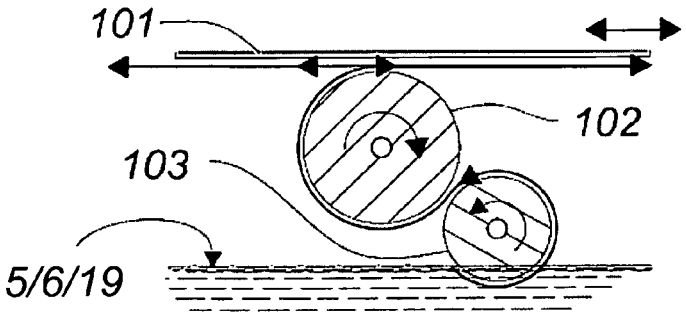
FIG. 5*e* is an illustration of a fluid applicator system depicting roller rotational directions for applying fluid to wire in accordance with certain exemplary embodiments of the present invention.

FIG. 5*e* illustrates the pickup roller 103 rotating counterclockwise while the applicator roller 102 rotates clockwise. In certain embodiments, the pickup roller 103 is downstream from the applicator roller 102. In certain embodiments, the applicator roller 102 is downstream from the pickup roller 103. In certain embodiments, the wires 101 flow from left to right, while in other embodiments, the wires 101 flow from right to left.

Figure 6A:
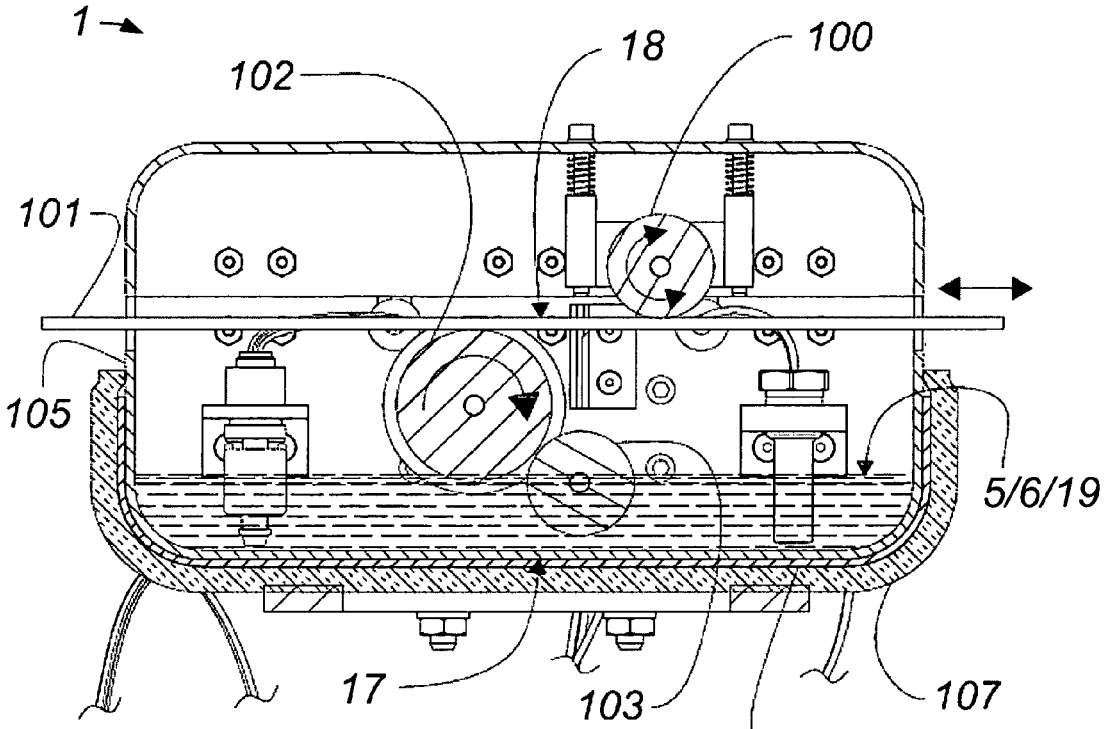
FIGS. 6*a* and 6*b* (collectively FIG. 6) are illustrations of a fluid applicator system for applying fluid to wire in accordance with certain exemplary embodiments of the present invention.
Figure 6B:
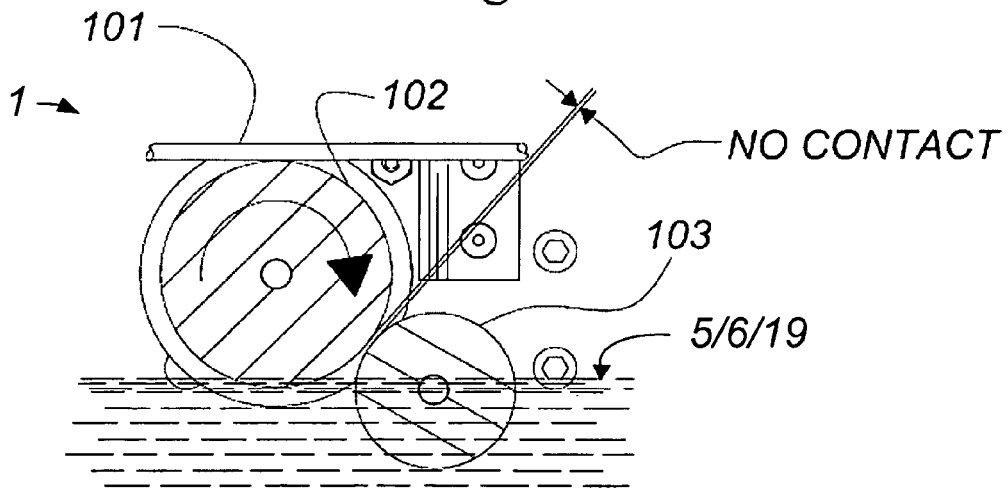

Turning now to FIG. 6, this figure illustrates an exemplary fluid applicator system for applying fluid to wire according to certain embodiments of the present invention. In the illustrated embodiment, the application roller 102 and the pickup roller 103 are separated. The fluid applicator system 1 is operated without a doctor blade and with the reservoir 6 filled to a level that places the fluid 5 in direct contact with the applicator roller 102. The fluid applicator system 1 of FIG. 6 can be an embodiment of the fluid applicator system 1 illustrated in FIGS. 1 and 2 as discussed above, but adapted as described below.

As illustrated, the fluid applicator system 1 operates in a mode where the fluid 5 transfers directly to the application roller 102. The applicator roller 102 is separated from the pickup roller 103 by a variable standoff distance, so that the applicator roller 102 and the pickup roller 102 are displaced from one another and are out of contact with one another. In such an embodiment, the standoff distance can be adjusted to control the amount of fluid on the application roller 102. That is, the fluid applicator system 1 can comprise a gap adjustment that may be actuated manually or under computer control.

Figure 7:
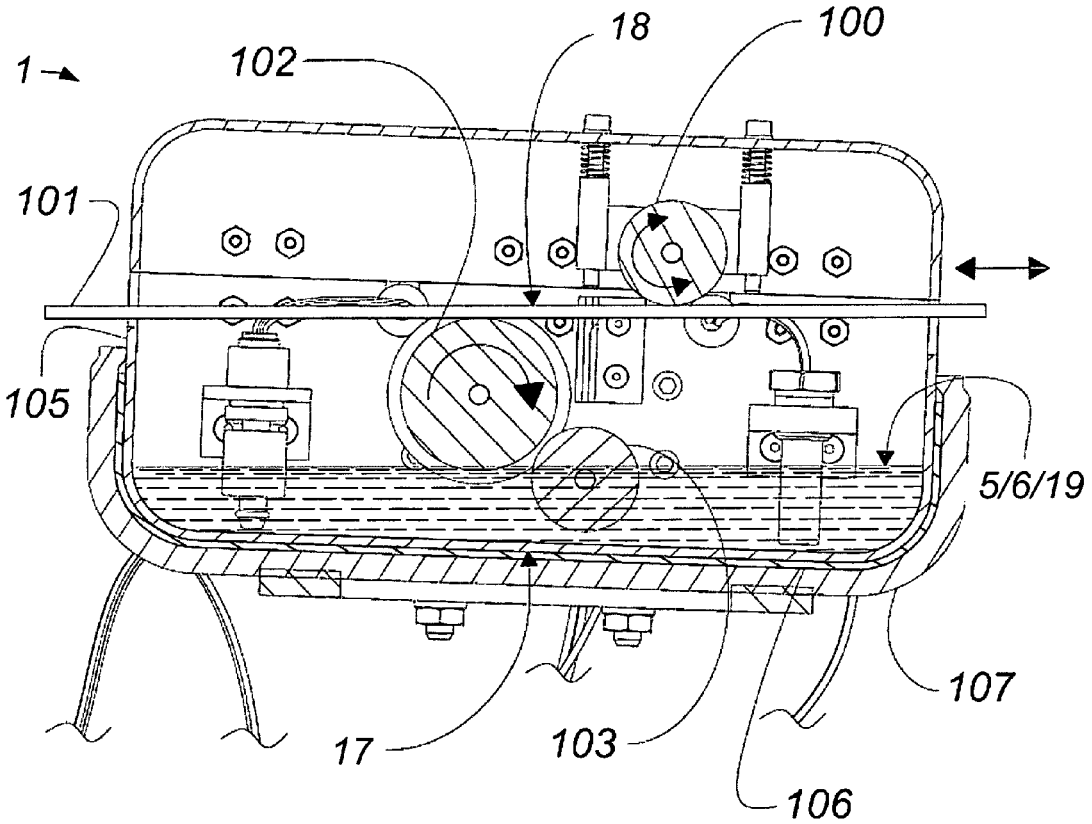
FIG. 7 is an illustration, in cross sectional view, of a fluid applicator system for applying fluid to wire in accordance with certain exemplary embodiments of the present invention.

Turning now to FIG. 7, this figure illustrates, in cross sectional view, an exemplary fluid applicator system for applying fluid to wire according to certain embodiments of the present invention. In the illustrated embodiment, the fluid applicator system 1 is operated without a doctor blade, with the pickup roller 103 and application roller 102 separated, and with the application roller 102 partially submerged in the reservoir 6. The fluid applicator system 1 of FIG. 7 can be an embodiment of the fluid applicator system 1 illustrated in FIGS. 1 and 2 as discussed above, but configured as discussed below.

In the illustrated mode of operation, the plane 17 defined by the bottom of the housing 105, the surface plane 19 defined by the upper surface of the fluid 5 level, and the plane 18 in which the wires 101 lie are out of parallel or obtuse with respect to one another. FIG. 7 illustrates how the flexible fluid path of the fluid applicator system 1 reduces sensitivity and susceptibility to inadvertent process and equipment variations, such as misalignments. Additionally, the flexible fluid path supports improved control over the amount of fluid 5 transferred to the wires 101 over a variety of wire speeds, different wire sizes, different fluid compositions, and different speeds of application.

Figure 8:
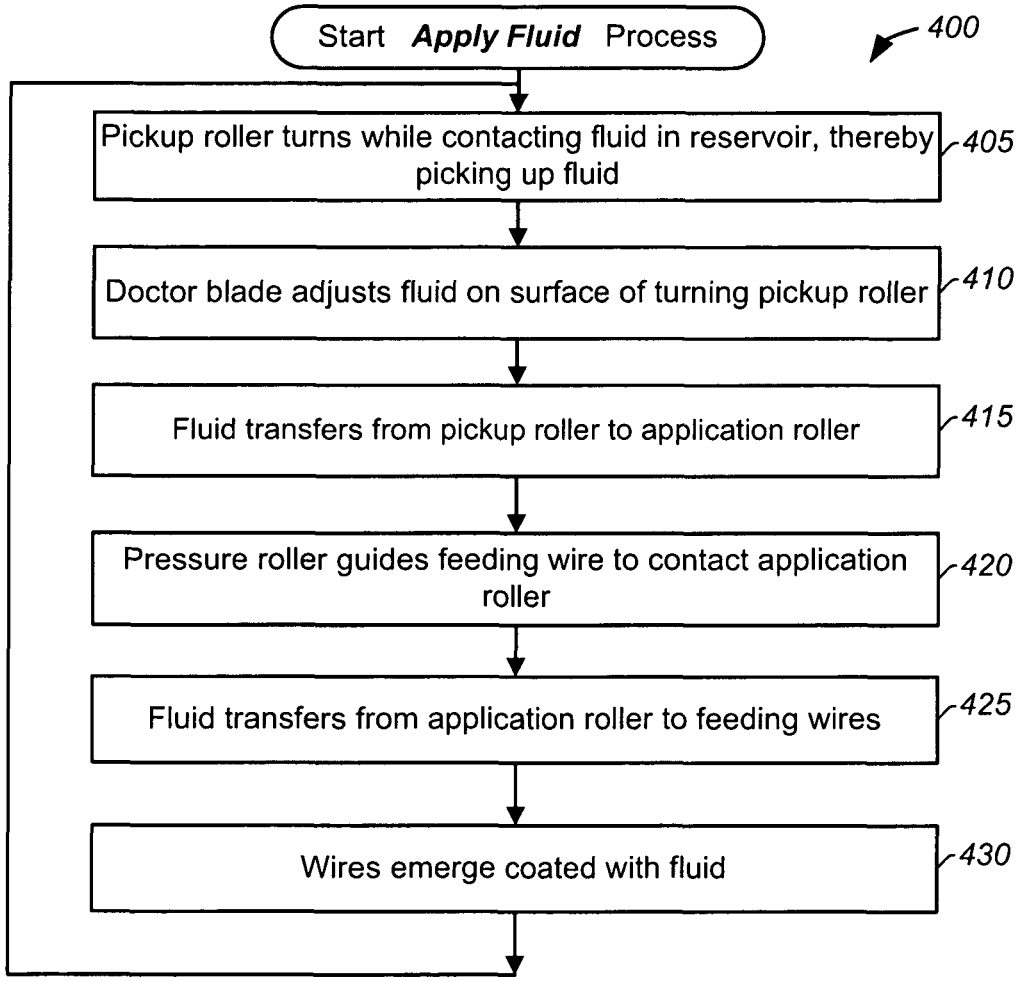
FIG. 8 is a flowchart of a process for applying fluid to wire in accordance with certain exemplary embodiments of the present invention.

Turning now to FIG. 8, this figure illustrates a flowchart for an exemplary process 400 for applying fluid 5 to wire 101 according to certain embodiments of the present invention. Process 400, which is entitled Apply Fluid, will be discussed with exemplary reference to the preceding figures, without limitation.

Certain steps in process 400, as well as other processes disclosed herein, may need to naturally precede others for the present invention to function appropriately or as described. However, the present invention is not limited to the order of the steps described if such order or sequence does not alter the functionality of the present invention to the level of nonsensical or render the invention inoperable. Accordingly, it is recognized that some steps may be performed before or after other steps or in parallel with other steps without departing from the scope and spirit of the present invention.

Certain exemplary embodiments of process 400 can be computer implemented, for example with a computer controlling the fluid applicator system 1 either partially or fully. Accordingly, the present invention can comprise multiple computer programs that embody certain functions disclosed herein, including textually, via figures, and/or as illustrated flowchart form. However, it should be apparent that there could be many different ways of implementing the invention in computer programming, and the invention should not be construed as limited to any one set of computer program instructions. Further, a skilled programmer would be able to write such a computer program to implement the disclosed invention without difficulty based on the figures and associated description in the application text, for example. Therefore, disclosure of a particular set of program code instructions is not considered necessary for an adequate understanding of how to make and use the present invention.

At step 405 of process 400, the pickup roller 103 becomes coated with fluid 5 as it rotates in contact with the reservoir 6. As discussed above, the pickup roller 103 may rotate in either direction so that the upper surface of the pickup roller 103 travels in the same direction or opposite to the moving wire 101. In certain embodiments, the pickup roller 103 can operate effectively while swamped in the reservoir 6.

At step 410, the surface of the pickup roller 103 skims past the doctor blade 104 to provide a uniform thickness of fluid 5 on that surface. The doctor blade 104 thereby removes excess fluid 5 from the pickup roller 103 and controls fluid thickness.

At step 415, fluid 5 transfers from the pickup roller 103 to the application roller 102, and the surfaces of those rollers 102, 103 move past one another. As discussed above, the application roller 102 and the pickup roller 103 can either rotate in common or rotating directions. Pressure or gap between those roller 102, 103 can be dynamically adjusted to control fluid application on the wires 101.

At step 420, the pressure roller 100 presses down on the wires 101, and the feeding wires 101 maintain contact with the application roller 102. Accordingly, the wires 101 flow along or in a plane between the application roller 102 and the pressure roller 100.

At step 425, fluid transfers from the application roller 102 to the wires 101. The wires thereby become wetted or coated with the fluid 5.

At step 430, the wires 101, with the applied fluid 5, emerge from the fluid applicator system 1. A downstream reel or other winding system can accumulate the wires, for example. Following step 430, process 400 iterates steps 405 through 430, whereby wires 101 continue flowing through the fluid applicator system 1, and the fluid applicator system 1 continues applying fluid 5 to the wires 101.

In certain exemplary embodiments of the present invention, Process 400 could be run so that the doctor blade 104 is not utilized and process step 410 is eliminated.

In certain exemplary embodiments of the present invention, fluid 5 is applied on 0.1 millimeters (mm) wire 101 at a rate that is in a range between about 0.012 grams per thousand meters of wire 101 and about 1.2 grams per thousand meters of wire 101. In certain exemplary embodiments, the fluid application rate is between about 0.00025 grams per thousand meters of wire 101 to about 2.5 kilograms per thousand meters of wire 101.

In certain exemplary embodiments of the present invention, material (such as the fluid 101) is transferred to a wire surface in a range averaging between about 0.1 milligrams (mg) of material per meter squared of wire surface to about 1.0 kilogram (Kg) of material per meter squared of wire surface. In certain exemplary embodiments, the fluid application covers or adheres to the wire surface with between about 1.0 mg per meter squared and about 0.25 Kg per meter squared of fluid.

In certain exemplary embodiments of the present invention, fluid application rate is set in a range from about 1 mg per pound of wire to about 500 mg per pound of wire. In certain exemplary embodiments, fluid application is between about 0.1 mg per pound of wire to about 1000 mg per pound of wire. In certain exemplary embodiments, fluid application is in a range between about 0.03 mg to 3 grams per pound of wire.

In certain exemplary embodiments of the present invention, wire 101 flows through the fluid applicator system 1 (and fluid is applied) at a wire speed that is between about 5 meters per minute and about 500 meters per minute. In certain exemplary embodiments, the wire speed is between about 1 meter per minute and about 1000 meters per minute. In certain exemplary embodiments, the wire speed is between about 0.1 and 1500 meters per minute.

In certain applications of wire manufacturing, the wire speed can be dictated by the line speed of a wire take-up, and the fluid applicator system 1 can be configured as discussed above to accommodate a wide range of such speeds. Speeds may range from about 1 meter per minute to about 1000 meters per minute, depending on wire manufacturing parameters and scale.

As discussed above, the fluid applicator system 1 can simultaneously apply fluid to an array of wires 101. For example, an embodiment in accordance with the illustration of FIG. 1 can apply fluid to twelve wires simultaneously, with the wires laterally separated from one another. The wires 101 in a single run may be of equal or varied diameters, for example between about 0.2 mm and about 2 mm in diameter. Additionally, the wires 101 in a singe run may have different cross sectional forms, for example some circular while others are oval, triangular, and rectangular.

In certain exemplary embodiments, the wires 101 in a single run can have different cross-sectional dimensions that span from about 0.5 mm to about 1.7 mm, with the fluid applicator system 1 providing a uniform application of fluid to each differently sized wire.

In certain exemplary embodiments, the wires 101 in a single run can have different cross-sectional dimensions that span from about 0.25 mm to 1.7 mm, with the fluid applicator system 1 providing a uniform application of fluid to each differently sized wire.

In certain exemplary embodiments, the wires 101 in a single run can have different cross-sectional dimensions that span from about 0.10 mm to 20 mm, with the fluid applicator system 1 providing a uniform application of fluid to each differently sized wire.

In certain exemplary embodiments, the wires 101 in a single run can have different cross-sectional dimensions that span from about 0.07 mm to 4.0 mm, with the fluid applicator system 1 providing a uniform application of fluid to each differently sized wire.

In certain exemplary embodiments, the wires 101 in a single run can have different cross-sectional dimensions that span from about 0.1 mm to 12.0 mm, with the fluid applicator system 1 providing a uniform application of fluid to each differently sized wire.

In one exemplary embodiment, the fluid applicator system 1 applies about 40 mg per meter squared of fluid to a 1.7 mm cross-section wire traveling at a wire manufacturing speed. In one exemplary embodiment, the fluid applicator system 1 applies about 66 mg per meter squared of fluid to a 1.1 mm cross-section wire traveling at a wire manufacturing speed. In one exemplary embodiment, the fluid applicator system 1 applies about 30 mg per meter squared of fluid to a 0.9 mm cross-section wire traveling at a wire manufacturing speed.

From the foregoing, it will be appreciated that an embodiment of the present invention overcomes the limitations of the prior art. Those skilled in the art will appreciate that the present invention is not limited to any specifically discussed application and that the embodiments described herein are illustrative and not restrictive. From the description of the exemplary embodiments, equivalents of the elements shown herein will suggest themselves to those skilled in the art, and ways of constructing other embodiments of the present invention will suggest themselves to practitioners of the art. Therefore, the scope of the present invention is to be limited only by the claims that follow.

What is claimed is:

1. A method for applying fluid to a magnet wire, the method comprising:

providing a reservoir of a fluid comprising less than approximately six percent by weight of solvents;

transferring fluid from the reservoir to a first cylinder in response to rotating the first cylinder while the first cylinder contacts the reservoir and is separated from the magnet wire;

transferring fluid between the first cylinder and a second cylinder in response to rotating the second cylinder while the second cylinder contacts the first cylinder; and;

transferring fluid from the second cylinder to the wire in response to feeding the magnet wire over the second cylinder while the second cylinder contacts the magnet wire and rotates, wherein a third cylinder positioned above the magnet wire and laterally offset from the second cylinder urges the magnet wire into contact with the second cylinder, and wherein the magnet wire does not simultaneously contact the second cylinder and the third cylinder at any given cross-sectional point along the magnet wire.

2. The method of claim 1, wherein a portion of the rotating first cylinder is below a surface of the reservoir and another portion of the rotating first cylinder is above the surface of the reservoir, and wherein the rotating second cylinder is above the surface of the reservoir.

3. The method of claim 1, wherein rotating the first cylinder comprises submerging a portion of the first cylinder in the reservoir, and wherein rotating the second cylinder comprises submerging a portion of the second cylinder in the reservoir.

4. The method of claim 1, wherein rotating the first cylinder comprises the first cylinder rotating in a direction that appears clockwise from an observation location, and wherein rotating the second cylinder comprises the second cylinder rotating in the direction that appears clockwise from the observation location.

5. The method of claim 1, wherein the first cylinder rotates in a clockwise direction and the second cylinder rotates in a counterclockwise direction as viewed from a common observation perspective.

6. The method of claim 1, further comprising the step of removing excess fluid from the second cylinder with a doctor blade, wherein fluid is transferred to the magnet wire in a range between about 0.1 mg per meter squared of magnet wire surface and about 1.0 Kg per meter squared of magnet wire surface.

7. The method of claim 1, wherein the first cylinder and the second cylinder rotate synchronously, and further comprising:

maintaining the fluid in a molten state in response to heating the reservoir, wherein at least one of the first cylinder or the second cylinder comprises a circumferential surface that is textured in accordance with a specification.

8. A method for wetting a plurality of magnet wires, the method comprising:

providing a reservoir of a fluid comprising less than approximately six percent by weight of solvents;

wetting a first cylinder by turning the first cylinder with the first cylinder partially submerged in the reservoir and with the first cylinder displaced from the plurality of magnet wires;

wetting a second cylinder by turning the second cylinder, wherein the second cylinder is displaced from the reservoir; and wetting the plurality of magnet wires by feeding the plurality of magnet wires past the wetted, turning second cylinder, wherein one of (i) a third cylinder, (ii) a brush, or (iii) a wick laterally offset from the second cylinder urges the feeding plurality of magnet wires into contact with the second wetted cylinder, and wherein each of the plurality of magnet wires does not simultaneously contact the second cylinder and the third cylinder, brush, or wick at an given cross-sectional point along the respective magnet wire.

9. The method of claim 8, wherein a molten material substantially fills a gap between the wetted first cylinder and the second cylinder, and wherein the molten material is transferred to the wire in a range between about 0.1 mg per meter squared of wire surface and about 1.0 Kg per meter squared of wire surface.

10. The method of claim 9, further comprising removing molten material from the first cylinder with a doctor blade.

11. The method of claim 8, wherein the plurality of magnet wires comprises a first magnet wire having a first diameter and a second magnet wire having a second diameter different from the first diameter.

12. The method of claim 8, wherein the first cylinder and the second cylinder turn in opposing directions.

13. The method of claim 8, wherein the first cylinder and the second cylinder turn in common directions.

14. The method of claim 8, wherein the reservoir comprises an upper surface of molten material disposed under the feeding plurality of magnet wires, and wherein the feeding plurality of magnet wires is disposed at an obtuse angle relative to the upper surface.

15. The method of claim 8, wherein the reservoir comprises an upper surface of molten material disposed under the feeding plurality of magnet wires, and wherein the feeding plurality of magnet wires is disposed at an acute angle relative to the upper surface.

16. The method of claim 1, wherein the fluid comprises at least one of (i) an enamel, (ii) a lubricant, or (iii) an insulation material.

17. The method of claim 1, wherein the magnet wire comprises a first magnet wire, and further comprising:

transferring fluid from the second cylinder to a second magnet wire, wherein both the first magnet wire and the second magnet wire simultaneously contact the second cylinder.

18. The method of claim 17, further comprising:

independently controlling the respective feeding speeds of the first magnet wire and the second magnet wire.

19. The method of claim 17, wherein the first magnet wire has a first diameter, and the second magnet wire has a second diameter different from the first diameter.

20. The method of claim 17, wherein the first magnet wire has a first cross-sectional shape and the second magnet wire has a second cross-sectional shape different from the first cross-sectional shape.

21. The method of claim 8, wherein the fluid comprises at least one of (i) an enamel, (ii) a lubricant, or (iii) an insulation material.

22. The method of claim 8, further comprising:

independently controlling the respective feeding speeds of at least two of the plurality of magnet wires.

23. The method of claim 1, further comprising:

controlling a temperature of the reservoir to maintain a desired viscosity of the fluid.

24. The method of claim 1, further comprising:

maintaining a consistent level of the fluid in the reservoir, wherein the consistent level of the fluid supports consistent application of the fluid onto the magnet wire.

* * * * *